US006585026B2

(12) United States Patent
Su et al.

(10) Patent No.: US 6,585,026 B2
(45) Date of Patent: Jul. 1, 2003

(54) SAFETY DEVICE FOR WINDOW CURTAINS

(75) Inventors: Cheng-Hsiung Su, Hai Jou Shi Chiau Town, Nan Hai City, Guang Dong Province (CN), 528211; Xianmu You, Rui An (CN)

(73) Assignee: Cheng-Hsiung Su, Nan Hai (CN)

( * ) Notice: Subject to any disclaimer, the term of this patent is extended or adjusted under 35 U.S.C. 154(b) by 0 days.

(21) Appl. No.: 10/053,444

(22) Filed: Jan. 17, 2002

(65) Prior Publication Data

US 2003/0062137 A1 Apr. 3, 2003

(30) Foreign Application Priority Data

Sep. 28, 2001 (CN) ..... 01264229 U
Sep. 28, 2001 (CN) ..... 01264230 U
Sep. 28, 2001 (CN) ..... 01264231 U

(51) Int. Cl.[7] ..... A47G 5/02
(52) U.S. Cl. ..... 160/243; 160/178.2 R
(58) Field of Search ..... 160/243, 178.1 R, 160/178.2 R, 168.1 R, 173 R

(56) References Cited

U.S. PATENT DOCUMENTS 1,301,603 A * 4/1919 Rathbun ..... 160/243
2,631,661 A * 3/1953 Nelson ..... 160/243 X
3,246,685 A * 4/1966 Anderson et al. ..... 160/243 X
4,603,725 A * 8/1986 Knight ..... 160/243
4,667,723 A * 5/1987 Spangenberg ..... 160/178.2 R
5,735,329 A * 4/1998 Akins et al. ..... 160/178.1 R
6,367,537 B1 * 4/2002 Hsu ..... 160/243
6,431,248 B1 * 8/2002 Hyman et al. ..... 160/178.1 R

* cited by examiner

*Primary Examiner*—David Purol
(74) *Attorney, Agent, or Firm*—Collard & Roe, P.C.

(57) ABSTRACT

A safety device for window curtains comprising a stopper safety hanger, a single wheel safety hanger and several safety clamps. When an object is caught by the curtain string, a small copper ball of the stopper safety hanger goes sideways from a copper wheel contracted by a steel spring wire making the copper wheel drop by its weight and loose the curtain string. A single wheel hanger is fitted for easy, balanced and convenient operation. Two string safety clamps automatically spring out from the two hangers by action of the spring clamp. The loosened curtain string separates the entangled object from danger, guaranteeing safe operation of the window curtains.

10 Claims, 6 Drawing Sheets

SAFETY DEVICE FOR WINDOW CURTAINS

BACKGROUND OF THE INVENTION

1. Field of the Invention

The present invention is safety device for window curtains, for preventing accidents with the curtain string.

2. The Prior Art

The basic structure of a window curtain contains the structure itself plus fittings comprising a hanger, a curtain string and a fixing device for the string. Because the curtain string is rather long, children might be caught by the neck when playing around. Tragedy is likely to happen causing death without other people around to help loosen the string. pets also might be caught by the curtain string as well.

The small copper ball on the stopper hanger in the existing window curtain is fixed by an aluminum nail to the shell case. Safety is not guaranteed with the existing stopper hanger when an object is entangled by the curtain string because the string will not release automatically.

For the existing type of single wheel hanger, the roller is fixed by an aluminum nail to the shell, leaving a clearance between the end face of roller and the shell. The difficulty is that the string will slip and jam into the gap when operating the curtain. The jamming of the curtain string decreases the safety of the single wheel hanger which is used together with the stopper hanger for balanced operation.

SUMMARY OF THE INVENTION

It is therefore an object of the present invention to provide a safety device to go with the curtain assembly, which will automatically release the string when an object is entangled to ensure the safe use of the window curtain in a simpler and easier way.

The invention comprises a safety device for window curtains having a stopper safety hanger and a single wheel safety hanger to be fitted at both ends of the top beam, and safety clamps in the clamping holes of the stopper safety hanger and the single wheel safety hanger.

The stopper safety hanger comprises a shell, a double steel wire, a copper wheel, a small copper ball and steel spring wire. The curtain string is jammed in between the copper wheel and the small copper ball. A slide groove is made in the wall of the shell and the small copper ball is inserted in the slide groove with the two ends of the steel spring on the shell to hold the small copper ball. The double steel wire limits the position of the copper ball.

The single wheel safety hanger comprises a shell, a roller and a rivet. The rivet is fixed to the shell and can move freely inside the shell. The roller has a groove which forms a concave ring for the curtain string to slide in.

The curtain string safety clamp comprises a spring clamp and plastic shell. The spring is put in the central groove of the plastic shell. The plastic shells separately join into the holes in the stopper safety hanger and the single wheel safety hanger. The curtain string separately fixes to the plastic shell. The other end of the curtain string may pass the safety ring.

The present invention comprises the stopper safety hanger, single wheel safety hanger and curtain string. When an object is wound on the curtain string, the small copper ball in the stopper safety hanger goes beside the copper wheel by traction of the steel spring wire and the copper wheel drops, making the string loose. Compared with the present technology, the small copper ball is not fixed to the shell but positioned inside the stopper shell with moving room, which will allow the small copper ball to have some room and not to jam the curtain string. The loosening of the curtain string will guarantee safe operation of the window curtain.

In the single wheel safety hanger, the roller has a concave groove which is used for the slide groove for the curtain string. The roller is put into the housing body of the shell and will not be jammed by the outgoing string. Compared with the present technology, the present invention is flexible and balanced for easier operation.

The present invention is used with the single wheel safety hanger and the stopper safety hanger. The easy operation of the single wheel safety hanger will ensure the balanced and safe operation of the stopper safety hanger.

Due to the safety clamps positioned separately inside the holes in the stopper safety hanger and the single wheel safety hanger, when an object is caught by the curtain string at a certain weight, the curtain string will spring out by force of the spring clamp from the clamping holes of the stopper safety hanger and single wheel safety hanger and loosen the string to the ground with the effect that the danger is eliminated for the children or pets thus caught.

Compared with the existing technology, the present invention ensures safe operation of the curtain assembly.

When an object is caught by the curtain string, the curtain string will loosen by force of the spring clamp from the clamping holes of the stopper safety hanger and single wheel safety hanger with the effect that the caught object is freed without other people's help. It is a simple structure for easy and convenient operation.

The present invention has no complicated fittings with its simple structure. The curtain string will not jam in operation to ensure easy and convenient operation.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
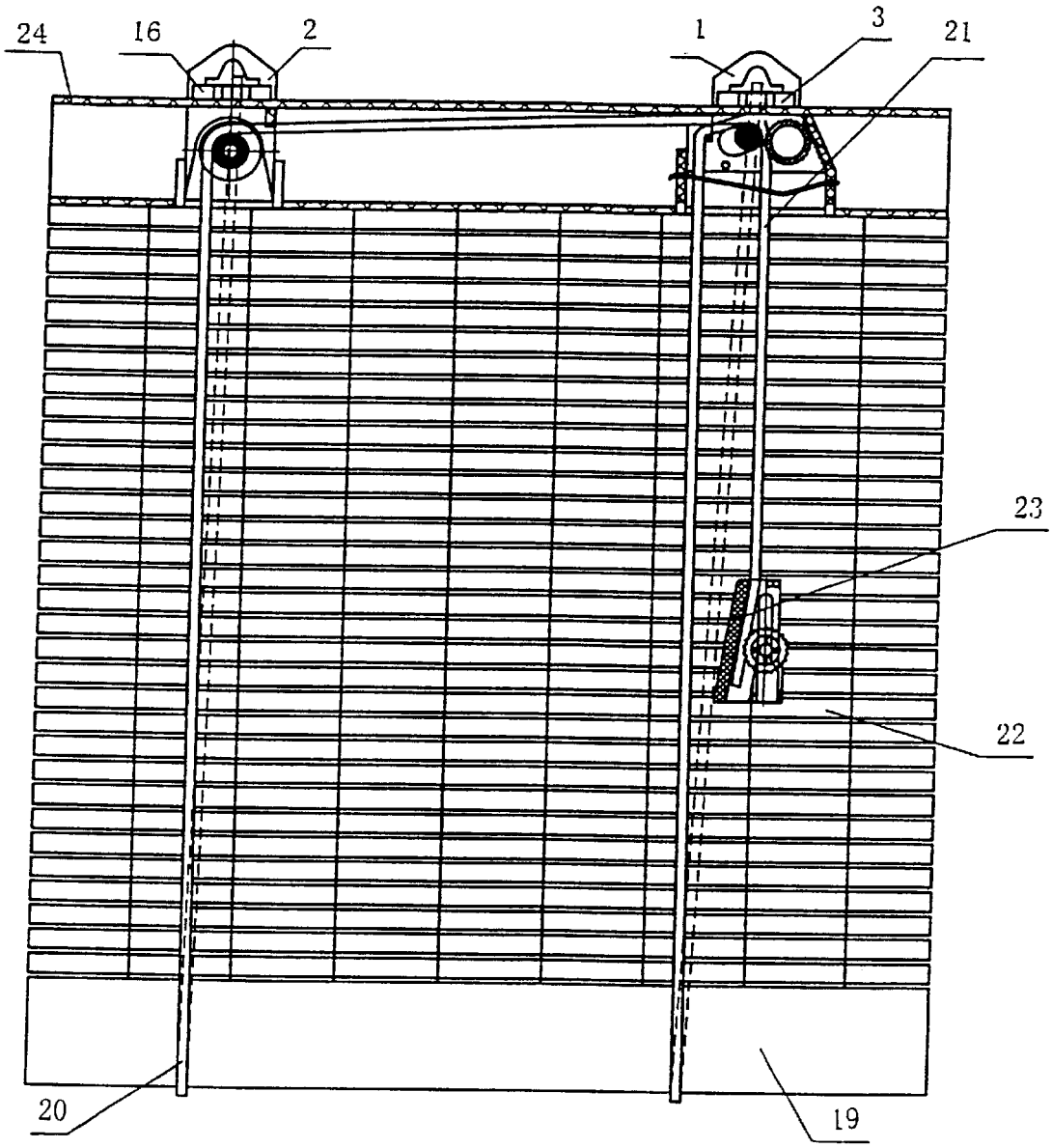
FIG. 1 is assembly of the safety device fitted with the window curtain.

Referring now in detail to the drawings, FIG. 1 shows a safety device for a window curtain, comprising: a stopper safety hanger 1, a single wheel safety hanger 2 and two safety clamps for the curtain string 3 and 16. Stopper safety hanger 1 and single safety hanger 2 are fitted at each end of the hang beam. There is a safety clamp for curtain string 3 and 16 fitted in the stopper safety hanger 1 and in the hole 15 of the single wheel safety hanger.

Figure 2:
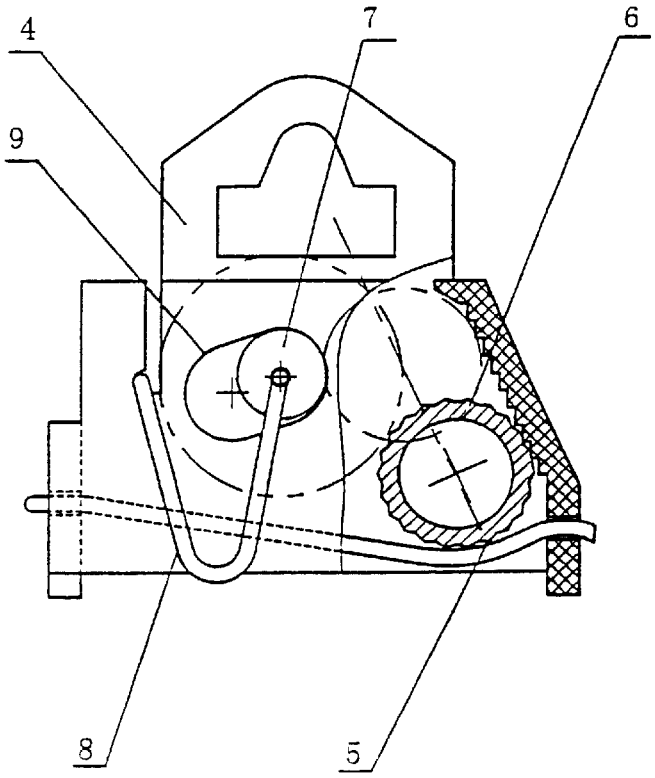
FIG. 2 is the structure of the stopper safety hanger.
Figure 3:
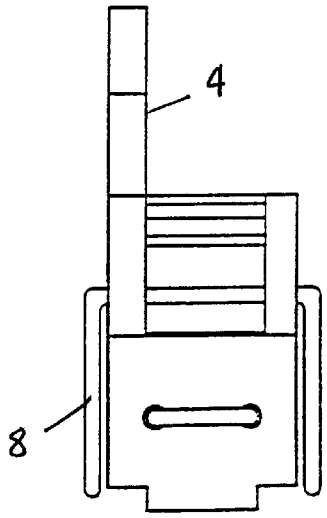
FIG. 3 is the left view of FIG. 2.

FIG. 2 and FIG. 3 show an embodiment of the application of the stopper safety hanger in the safety device of the present invention. The stopper safety hanger comprises a shell 4, a double steel wire 5, a copper wheel 6, a small copper ball 7 and steel spring wire 8. The curtain string 20, 21 is jammed in between the copper wheel 6 and the small copper ball 7, with double steel wire 5 limiting the copper wheel 6. When the double steel wire 5 is installed, the curtain string will be close to the double steel wire and not to the inner wall of the plastic shell to reduce friction and increase time of use. The shell 4 is the stopper plastic shell in which the slide groove 9 is made and the small copper ball 7 is installed inside. The steel spring wire 8 on the shell 4 is bent into a U shape and fixed to shell 4. The two ends of the steel spring wire 8 are fixed to the small copper ball. When operating the curtain, if an object is caught and exerts a certain weight, the steel spring wire 8 will go beside and tract the small copper ball 7 away from the copper wheel 6 which drops by its weight, pulling down the string and causing the object to drop safely to the ground.

Figure 4:
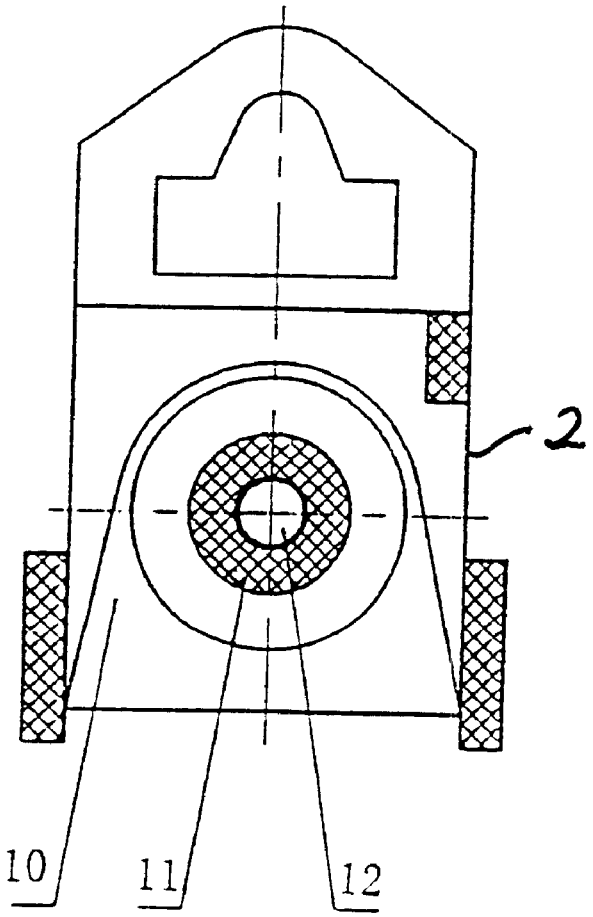
FIG. 4 is the structure of the single wheel safety hanger fitted with the safety device.
Figure 5:
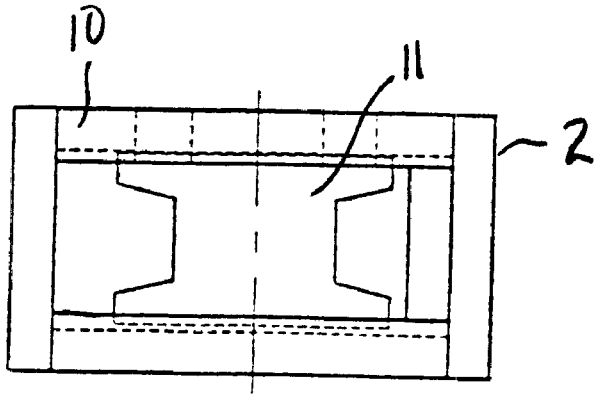
FIG. 5 is the top view of FIG. 4.

FIG. 4 and FIG. 5 show an example of the embodiment of the single wheel safety hanger in the safety device of the present invention. The single wheel safety.hanger comprises a plastic shell 10, a roller 11 and a rivet 12. The shell 10 is a plastic shell to which the roller axis is fixed by rivet 12. The roller 11 has a concave groove and on the outside surface is a concave ring for the string 20, which operates in the ring with ease of balance.

Figure 6:
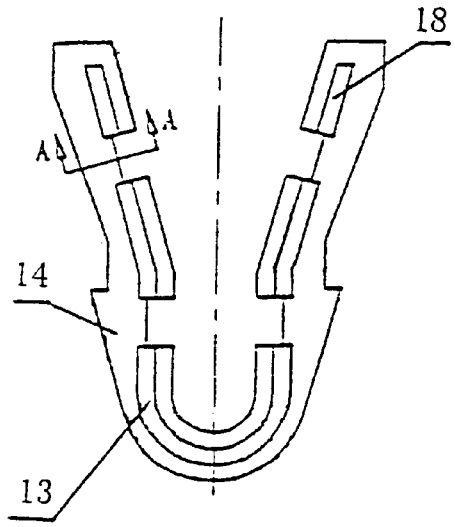
FIG. 6 is the structure of the safety clamp of the safety device.
Figure 7:
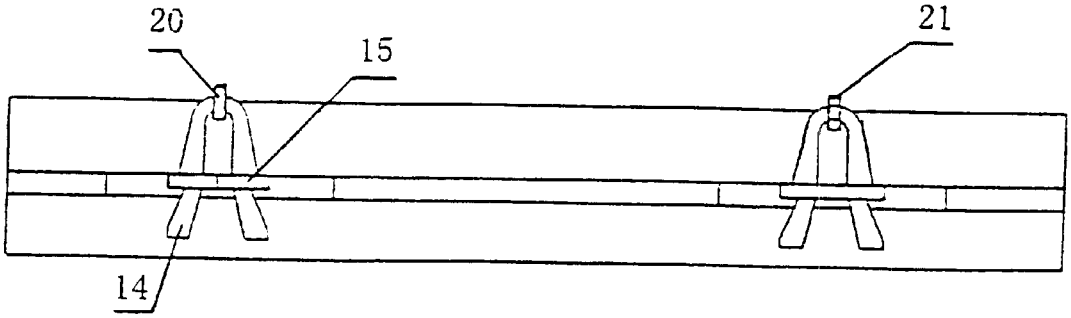
FIG. 7 is the assembly diagram of the curtain string, safety clamp, stopper safety hanger and single wheel safety hanger.
Figure 8:
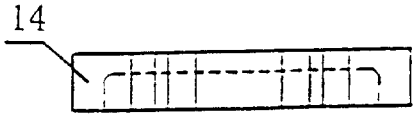
FIG. 8 is the top view of the FIG. 6.

FIG. 6 shows an example of the embodiment of the two safety clamps 3, 16 in the safety device of the present invention. Safety clamps 3, 16 comprise spring clamp 13 and plastic shell 14 which is in a U shape with the two legs going outwards. Spring clamp 13 is fixed with the plastic shell 14. As shown in FIG. 7, plastic shell 14 of the two safety clamps 3, 16 separately goes into holes 15 in the stopper safety hanger 1 and single wheel safety hanger 2. Curtain string 21, 20 is separately fixed to the center of the arc of the U shaped plastic shell 14 on the safety clamps 3,16. When curtain string 21, 20 is under certain weight, the safety clamps 3, 16 will automatically spring out and the curtain string will drop to the ground. As shown in FIG. 8, to join the plastic clamp 13 and the shell 14, a groove 17 is set in spring clamp 13 in the plastic shell 14. Four clamping points 18 are set on the upper part of groove 17. Clamping points 18 are evenly laid out on groove 17. Spring clamp 13 and groove 17 act to press spring clamp 13 into groove 17 with clamping point 18 to fix the spring clamp 13 in the groove 17. Spring clamp 13 increases the flexibility of the whole of the safety clamp under stresses.

Figure 9:
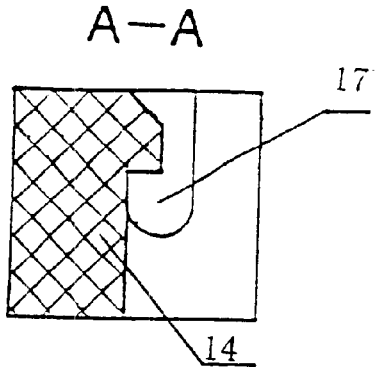
FIG. 9 is the A—A sectional view of FIG.6.
Figure 10:
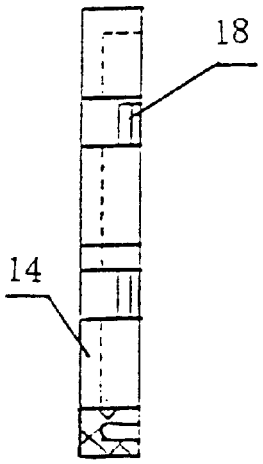
FIG. 10 is the layout of the clamping hole position on the concave groove of the plastic shell of the safety device.

As shown in FIG. 9 and FIG. 10, clamping point 18 is fixed to one side of plastic shell 14, and the other side of plastic shell 14 is extended to the upper part of the groove 17 with some clearance between the facet and that of the groove. The section of clamping point 18 is in a ladder shape having a slated top. A design as such is to insert the spring clamp 13 into the groove 17 smoothly. To fix tightly the safety clamps 3, 16 and the clamping holes 15 on the stopper safety hanger 1 and single wheel safety hanger 2, a matching angle has been set up at the center of the plastic shell 14.

Figure 12:
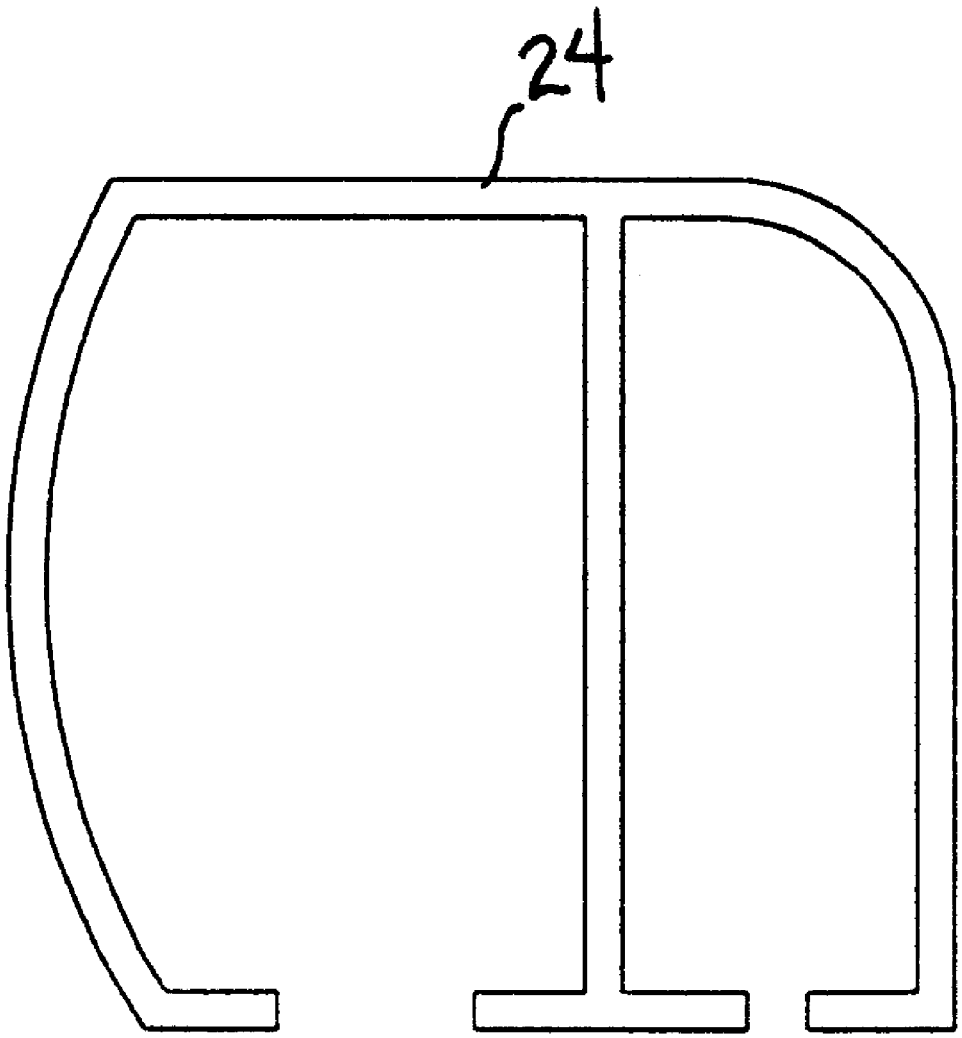
FIG. 12 is the cross-sectional view of the arc double rails.

The safety device of the present invention is fixed on the arc shaped double rails 24 shown in FIG. 12. As shown in FIG. 1, FIG. 2, FIG. 4 and FIG. 6, single wheel safety hanger 2 comprises the safety clamp 16 and plastic shell 14.

Curtain string 20 passes from behind curtain blade 22 and lower rail 19, crosses the front of the curtain, passes the arc shaped double rails 24 and single wheel safety hanger 2, travels by the roller 11, passes between the copper wheel 6 and the small copper ball 7 and passes through the legs of the steel wire 5 to reach the safety ring 23.

Curtain string 21 on plastic shell 14 on stopper safety hanger 1, which goes from behind the curtain blade 22 and the lower rail 19, crosses over the front of the curtain, passes the arc double rails 24 and spring wire 8, travels between the copper wheel 6 and the small copper ball 7 and passes through the legs of the steel wire 5 to reach the safety ring 23.

Figure 11:
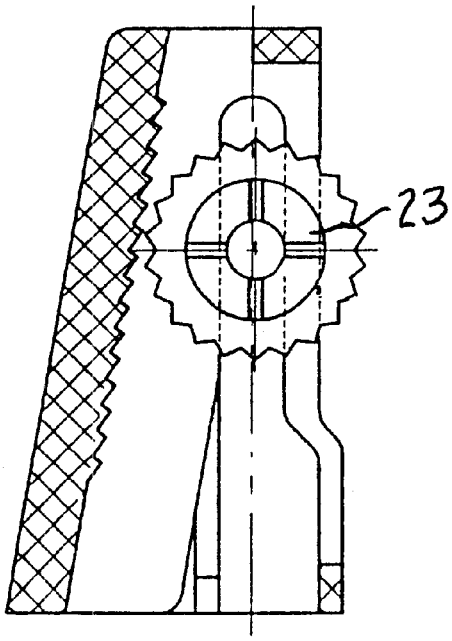
FIG. 11 is the top view of the safety ring.

As shown in FIG. 11, safety ring 23 in the present invention is a frame with openings at the upper and lower part. A gear is inserted in the longitudinal opening at the corresponding side. Two slide grooves are made on the other two inner walls. The gear can move along in the slide grooves and the longitudinal opening. The curtain string passes the upper and lower opening to move along the inclined face to go into the safety ring 23 with the gear tightening the string at the top of the longitudinal opening. When an object is caught, the weight of the object will pull the string away from the gear and the string is loosened, guaranteeing the safety in operation.

The process of use is as follows: as shown in FIG. 1 when operating the curtain, pull down the safety ring 23 to make the curtain string 20, 21 move. At this moment the copper wheel 6 will drop by its weight and stop reaching the double steel wire 5. As the strings 20, 21 move, the curtain blade 22 will roll up. When releasing the curtain, blade 22 rolls down and the teeth of the copper wheel 6 will go with the rack traveling along the inclined face upwards until clamping the small copper ball and tightening the string 20, 21 to return to the original position.

Accordingly, while only a single embodiment of the present invention has been shown and described, it is obvious that many changes and modifications may be made thereunto without departing from the spirit and scope of the invention.

What is claimed is:

1. A safety device for window curtains, comprising:

a hang beam;

a stopper safety hanger mounted at one end of said hang beam and comprising;

(a) a first shell having a slide groove on a wall of said shell;

(b) a small copper ball installed in the slide grove;

(c) a steel spring wire attached to the first shell and joined with the copper ball;

(d) a copper wheel mounted in the first shell;

(e) a double steel wire that limits a position of the copper wheel; and (f) curtain strings disposed between the copper wheel and small copper ball;

a single wheel safety hanger mounted at another end of said hang beam, said single wheel safety hanger comprising:

(a) a second shell;

(b) a roller mounted in the second shell and having a concave groove, said concave groove serving as a slide channel for the curtain strings; and (c) a rivet connecting the roller and the second shell, the roller turning freely in the shell; and safety clamps for the curtain strings, said clamps mounted in holes of the stopper safety hanger and the single wheel safety hanger, said safety clamps each comprising:

(a) a spring clamp; and (b) a third plastic shell flexibly connected to the spring clamp; said third plastic shell clamping separately into one of the holes of the stopper safety hanger and the single wheel safety hanger, and wherein the curtain strings are fixed separately on the third plastic shell.

2. The safety device of 1, wherein:

one of the curtain strings is fixed on the safety clamp mounted on the single wheel safety hanger;

said curtain string passes the roller of the single wheel safety hanger and enters between the copper wheel of the stopper safety hanger and the small copper ball; and said curtain string passes the curtain and the steel spring wire of the stopper safety hanger, enters between the copper wheel and the small copper ball and then, by passing the legs of the double steel wire, enters a safety ring.

3. The safety device of claim 1, wherein the steel spring wire of the stopper safety hanger is in a U shape and travels through and is fixed to said first shell.

4. The safety device of claim 1, wherein the third shell contains a concave groove, and wherein said spring clamp is a steel wire matching the shape of the concave groove, the concave groove having several clamping points.

5. The safety device of claim 1, wherein the third shell is in a U shape with 2 legs tilting outwards.

6. The safety device of claim 4, wherein one end of one of the clamping points is fixed to one side of the third shell and the other end of said one clamping point extends to an upper part of an opening of the concave groove, and wherein a clearance exists between sides of the plastic shell and sides of the groove opening.

7. The safety device of claim 6, wherein a section of the clamping point is in a ladder shape with an inclined top.

8. The safety device of claim 4, wherein four clamping points are laid out in a symmetric position on the concave groove.

9. The safety device of claim 1, wherein a clamping angle of the safety clamp matches a hole at a center part of the third shell.

10. The safety device of claim 2, wherein the safety ring comprises a frame with openings at top and bottom sides; one face of said ring being inclined downwards; and an opposite side of said ring having a longitudinal opening in which a roller is encased; and wherein two slide grooves are cut at a corresponding location in inner walls of opposite sides of said frame; wherein the roller moves along in the two slide grooves towards the opening; and wherein the curtain string goes through the safety ring in a direction of the inclined face; and further comprising a gear that grips teeth on the inner wall and catches the curtain string at a top position in the longitudinal opening.

* * * * *